US011521558B2

(12) United States Patent
Kim et al.

(10) Patent No.: US 11,521,558 B2
(45) Date of Patent: Dec. 6, 2022

(54) DISPLAY DEVICE, AND METHOD OF OPERATING A DISPLAY DEVICE

(71) Applicant: SAMSUNG DISPLAY CO., LTD., Yongin-si (KR)

(72) Inventors: Won Tae Kim, Hwaseong-si (KR); Sun-Koo Kang, Seoul (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/138,017

(22) Filed: Dec. 30, 2020

(65) Prior Publication Data

US 2021/0295781 A1 Sep. 23, 2021

(30) Foreign Application Priority Data

Mar. 18, 2020 (KR) ..... 10-2020-0033265

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2310/027* (2013.01); *G09G 2310/08* (2013.01); *G09G 2320/0209* (2013.01); *G09G 2320/0233* (2013.01); *G09G 2330/02* (2013.01)

(58) Field of Classification Search
None
See application file for complete search history.

(56) References Cited

U.S. PATENT DOCUMENTS

2018/0374446 A1* 12/2018 Dai ..... G09G 3/3688

FOREIGN PATENT DOCUMENTS

| | | |
|---|---|---|
| KR | 10-1370044 | 2/2014 |
| KR | 10-2014-0071727 | 6/2014 |
| KR | 10-2014-0081098 | 7/2014 |
| KR | 10-2019-0030766 | 3/2019 |

* cited by examiner

*Primary Examiner* — Christopher J Kohlman
(74) *Attorney, Agent, or Firm* — F. Chau & Associates, LLC

(57) ABSTRACT

The present disclosure relates to a display device. The display device includes a display panel, data lines, a constant voltage line, a feedback line, and a display driver. The display panel includes pixels. The data lines transfer data voltages to the pixels. The constant voltage line transfers a constant voltage to the pixels. The feedback line is coupled to the constant voltage line. The display driver is configured to sense a change amount of the constant voltage through the feedback line, generate compensated image data by compensating image data according to the sensed change amount of the constant voltage, and provide the data voltages corresponding to the compensated image data to the pixels.

16 Claims, 14 Drawing Sheets

FIG. 6

| | 0G | 32G | 64G | 96G | 128G | 160G | 192G | 224G | 255G |
|---|---|---|---|---|---|---|---|---|---|
| +0.3V | 0G | +8G | +7G | +7G | +7G | +6G | +6G | +5G | 0G |
| +0.2V | 0G | +6G | +5G | +5G | +5G | +4G | +4G | +3G | 0G |
| +0.1V | 0G | +4G | +3G | +3G | +3G | +2G | +2G | +1G | 0G |
| 0 | 0G | 0G | 0G | 0G | 0G | 0G | 0G | 0G | 0G |
| -0.1V | 0G | -5G | -4G | -4G | -4G | -3G | -2G | -1G | 0G |
| -0.2V | 0G | -7G | -6G | -6G | -6G | -5G | -4G | -3G | 0G |
| -0.3V | 0G | -8G | -7G | -7G | -7G | -6G | -5G | -4G | 0G |

DISPLAY DEVICE, AND METHOD OF OPERATING A DISPLAY DEVICE

CROSS-REFERENCE TO RELATED APPLICATION(S)

This application claims priority under 35 USC § 119 to Korean Patent Application No. 10-2020-0033265, filed on Mar. 18, 2020 in the Korean Intellectual Property Office (KIPO), the contents of which are incorporated by reference herein in its entirety.

BACKGROUND

1. Field

Exemplary embodiments of the present inventive concept relate to a display device, and more particularly to a display device capable of reducing or eliminating horizontal crosstalk, and a method of operating the display device.

2. Description of the Related Art

Display devices are used to convey information to a user. Electronic devices that include a display include televisions, mobile phones, and computers. The display of an electronic device generally includes multiple light emitting pixels. These pixels illuminate in specific patterns to display a message or image. In some devices, the pixels of a display device receive multiple voltages including data voltages, a constant voltage, and a power supply voltage, and emit light based on the received voltages.

However, the constant voltage may be changed by a coupling between data lines that transfer the data voltages and a constant voltage line that transfers the constant voltage. For example, the constant voltage may change when the data voltages for a current row of pixels change or during a transition from the data voltages for a previous row of pixels. If the constant voltage is changed, the pixels may not emit the desired luminance, and horizontal crosstalk may occur. Therefore, there is a need in the art for systems and methods to compensate for constant voltage change of a pixel.

SUMMARY

Some exemplary embodiments provide a display device capable of reducing or eliminating horizontal crosstalk, and a method of operating the display device.

According to exemplary embodiments, there is provided a display device including a display panel including pixels, data lines for transferring data voltages to the pixels, a constant voltage line for transferring a constant voltage to the pixels, and a feedback line coupled to the constant voltage line, and a display driver configured to sense a change amount of the constant voltage through the feedback line, to generate compensated image data by compensating image data according to the sensed change amount of the constant voltage, and to provide the data voltages corresponding to the compensated image data to the pixels.

In exemplary embodiments, the display driver may sense, through the feedback line, the change amount of the constant voltage induced by coupling between the data lines and the constant voltage line when the data voltages are changed. In exemplary embodiments, the constant voltage may be an initialization voltage, and the constant voltage line may be an initialization voltage line.

In exemplary embodiments, the display driver may sense, through the feedback line, the change amount of the constant voltage induced when the data voltages for an N-th row of the pixels are changed from the data voltages for an (N−1)-th row of the pixels, where N is an integer greater than 1, may generate the compensated image data for an (N+1)-th row of the pixels by compensating the image data for the (N+1)-th row of the pixels according to the sensed change amount of the constant voltage, and may provide the data voltages corresponding to the compensated image data to the (N+1)-th row of the pixels.

In exemplary embodiments, the display driver includes a sensing circuit configured to generate a change amount sensing value by sensing the change amount of the constant voltage through the feedback line, a data compensator configured to determine compensation values corresponding to the change amount sensing value, and to generate the compensated image data by adding the compensation values to the image data, and a data driver configured to receive the compensated image data from the data compensator, and to provide the data voltages corresponding to the compensated image data to the pixels.

In exemplary embodiments, the feedback line may be formed around a display region of the display panel where the pixels are located, and may be coupled to the constant voltage line at an edge portion of the display region. In exemplary embodiments, the display panel may include, as the feedback line, a first feedback line coupled to the constant voltage line at a first edge portion of a display region of the display panel distant from the display driver, and a second feedback line coupled to the constant voltage line at a second edge portion of the display region close to the display driver.

In exemplary embodiments, the display driver may compensate the image data for the pixels located at a first half of the display region based on the change amount of the constant voltage sensed through the first feedback line, and may compensate the image data for the pixels located at a second half of the display region based on the change amount of the constant voltage sensed through the second feedback line.

In exemplary embodiments, a display region of the display panel may be divided into a plurality of display blocks, and the display panel may include, as the feedback line, a plurality of feedback lines coupled to the constant voltage line at the plurality of display blocks, respectively. In exemplary embodiments, the display driver may compensate the image data for the pixels located at one display block of the plurality of display blocks based on the change amount of the constant voltage sensed through one of the plurality of feedback lines corresponding to the one display block.

In exemplary embodiments, the display driver may include a compensation map configured to store a plurality of compensation values according to a plurality of change amount sensing values and a plurality of gray levels. The display driver may compensate the image data by using the compensation map.

In exemplary embodiments, a display region of the display panel may be divided into a plurality of display blocks. The display driver may include a plurality of compensation maps respectively for the plurality of display blocks. The display driver may compensate the image data for the pixels located at one display block of the plurality of display blocks by using one of the plurality of compensation maps corresponding to the one display block.

In exemplary embodiments, a display region of the display panel may be divided into a plurality of display blocks.

The display driver may include a first compensation map for an uppermost display block of the plurality of display blocks, and a second compensation map for a lowermost display block of the plurality of display blocks. The display driver may compensate the image data for the pixels located at one display block of the plurality of display blocks by interpolating first compensation values extracted from the first compensation map and second compensation values extracted from the second compensation map.

In exemplary embodiments, the constant voltage may be a power supply voltage, and the constant voltage line may be a power supply voltage line. In exemplary embodiments, the display driver may sense the change amount of the constant voltage through the feedback line in a previous frame period, and may compensate the image data in a current frame period according to the sensed change amount of the constant voltage in the previous frame period when the image data in the current frame period are substantially the same as the image data in the previous frame period.

According to exemplary embodiments, there is provided a method of operating a display device. In the method, a change amount of a constant voltage of a constant voltage line is sensed through a feedback line, compensated image data are generated by compensating image data according to the sensed change amount of the constant voltage, and the data voltages corresponding to the compensated image data are provided to pixels.

In exemplary embodiments, the change amount of the constant voltage induced by coupling between data lines and the constant voltage line when data voltages of the data lines are changed may be sensed through the feedback line. In exemplary embodiments, the constant voltage may be an initialization voltage, and the constant voltage line may be an initialization voltage line.

In exemplary embodiments, the change amount of the constant voltage induced when the data voltages for an N-th row of the pixels are changed from the data voltages for an (N−1)-th row of the pixels may be sensed through the feedback line, where N is an integer greater than 1. The compensated image data for an (N+1)-th row of the pixels may be generated by compensating the image data for the (N+1)-th row of the pixels according to the sensed change amount of the constant voltage. In exemplary embodiments, the constant voltage may be a power supply voltage, and the constant voltage line may be a power supply voltage line.

As described above, in a display device and a method of operating the display device according to exemplary embodiments, a change amount of a constant voltage (e.g., an initialization voltage, a power supply voltage, etc.) induced by coupling between data lines and a constant voltage line may be sensed through a feedback line, and image data may be compensated according to the sensed change amount of the constant voltage. Accordingly, horizontal crosstalk caused by the coupling between the data lines and the constant voltage line may be reduced or eliminated.

BRIEF DESCRIPTION OF THE DRAWINGS

Illustrative, non-limiting exemplary embodiments will be more clearly understood from the following detailed description in conjunction with the accompanying drawings.

FIG. 6 is a diagram illustrating an example of a compensation map included in a display device according to exemplary embodiments.

DETAILED DESCRIPTION OF THE EMBODIMENTS

The present disclosure relates generally to display device and more particularly, to display device with a feedback line for sensing a change amount of a constant voltage between data lines and a constant voltage line. Accordingly, image data may be compensated based on the sensed change in constant voltage.

In some cases, the pixels of a display device are powered by multiple voltages including data voltages, a constant voltage, and a power supply voltage, and may emit light based on the received voltages. However, the constant voltage may be changed by coupling between data lines and a constant voltage line used to transfer the constant voltage. When the constant voltage changes, the pixels may not illuminate with the desired luminance, producing incorrect light emittance and possible horizontal crosstalk (i.e., a defect caused by interference between pixels).

Embodiments of the present disclosure include a display panel with a plurality of pixels, data lines, a constant voltage line, a feedback line, and a display driver. The data lines transfer data voltages to the pixels. The constant voltage line transfers a constant voltage to the pixels. The feedback line is coupled to the constant voltage line. The display driver is configured to sense a change amount of the constant voltage through the feedback line, generate compensated image data by compensating image data according to the sensed change amount of the constant voltage, and provide the data voltages corresponding to the compensated image data to the pixels.

Hereinafter, embodiments of the present inventive concept will be explained in detail with reference to the accompanying drawings.

Figure 1:
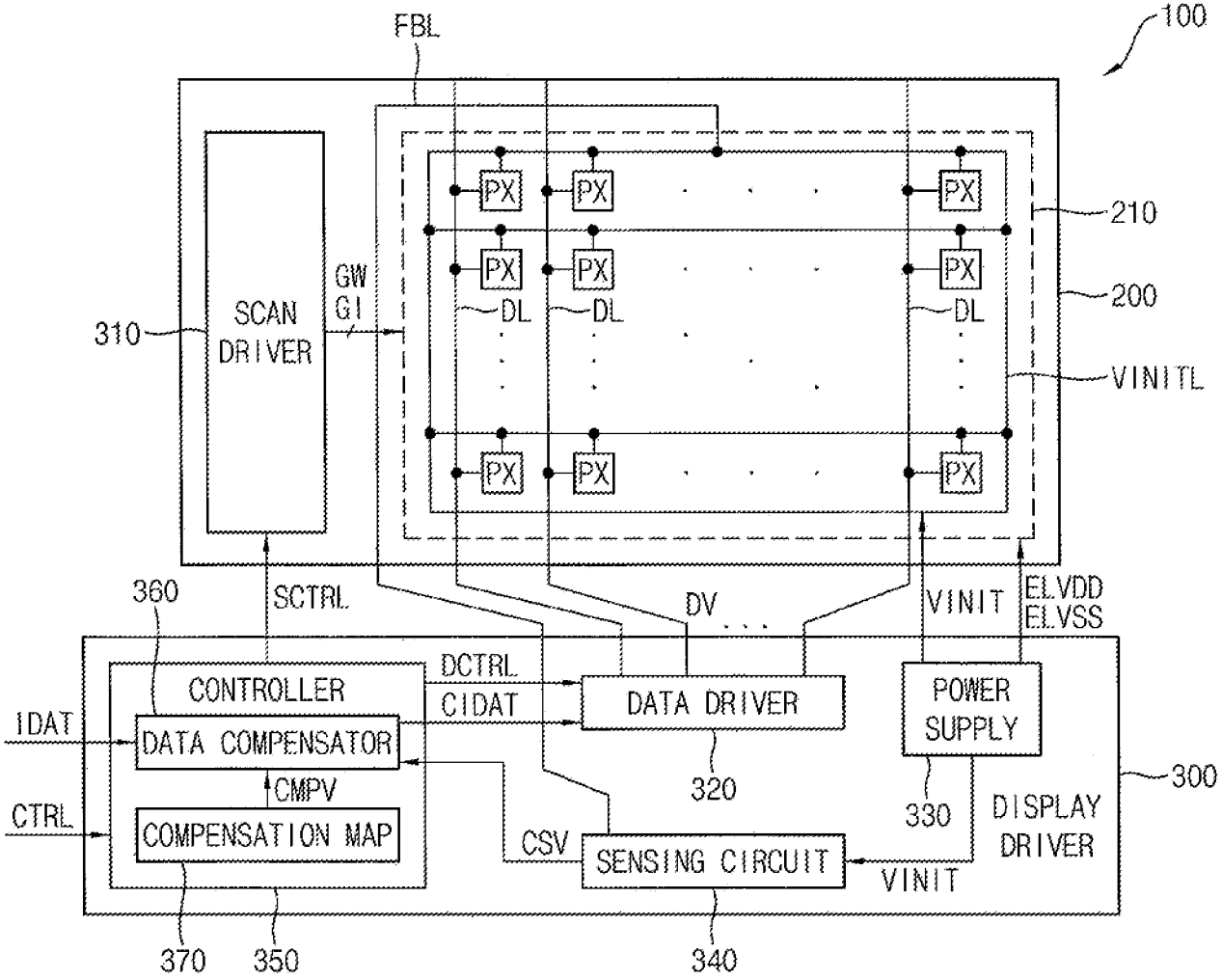
FIG. 1 is a block diagram illustrating a display device according to exemplary embodiments.
Figure 2:
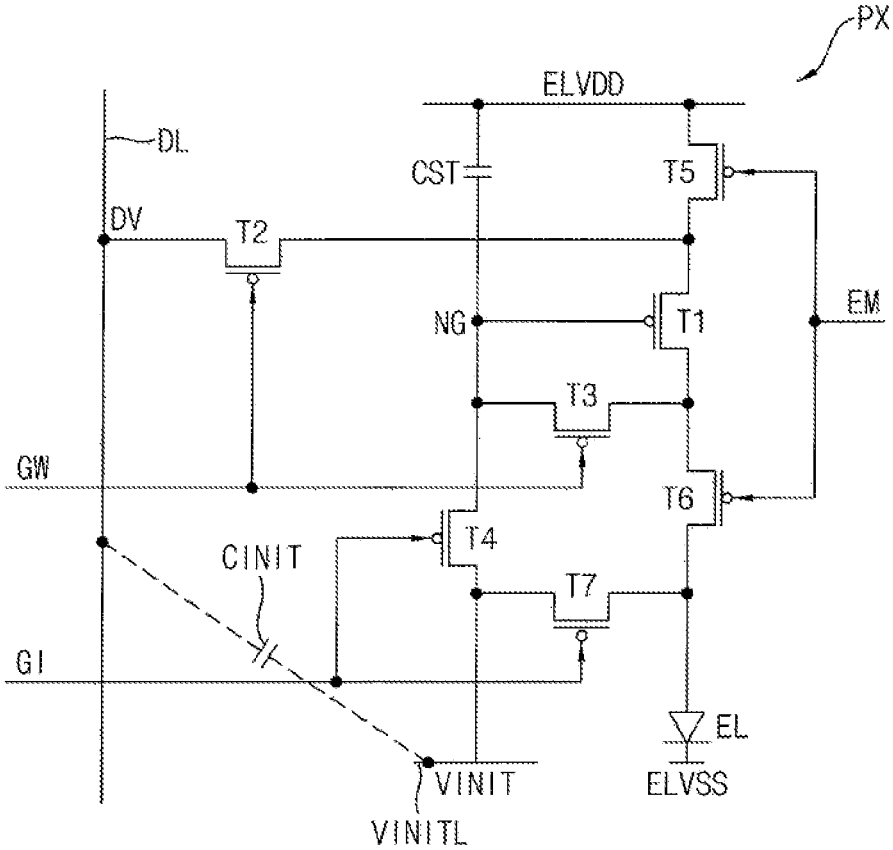
FIG. 2 is a circuit diagram illustrating an example of each pixel included in a display device according to exemplary embodiments.
Figure 3:
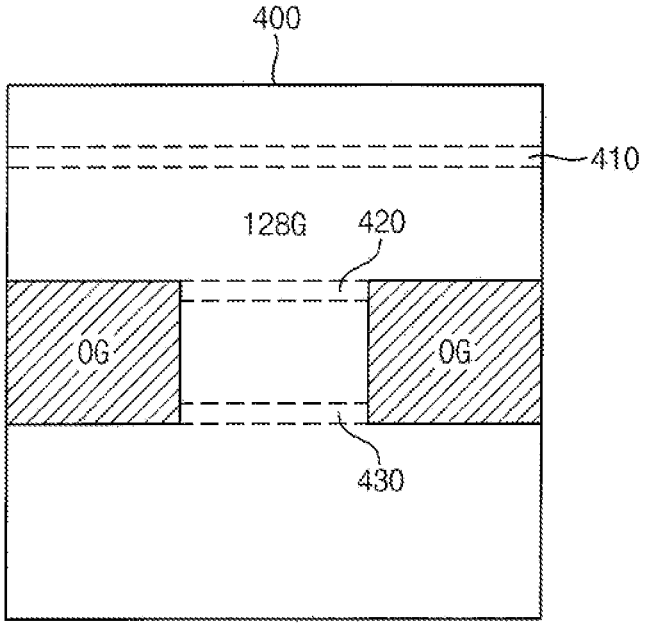
FIG. 3 is a diagram illustrating an example of image data for a display panel.
Figure 4:
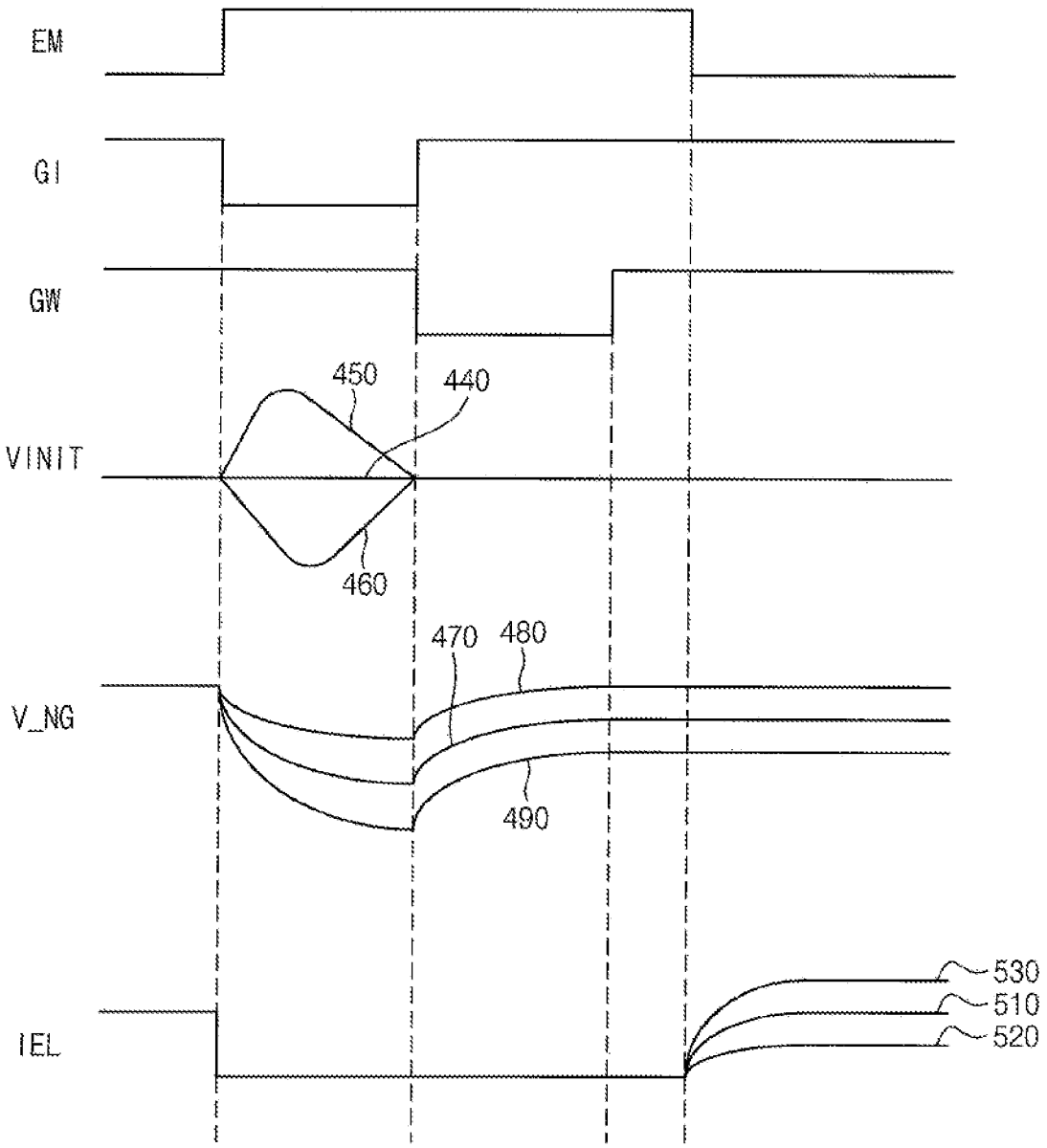
FIG. 4 is a timing diagram for describing examples where an initial voltage is changed when image data of FIG. 3 are provided in a conventional display device.
Figure 5:
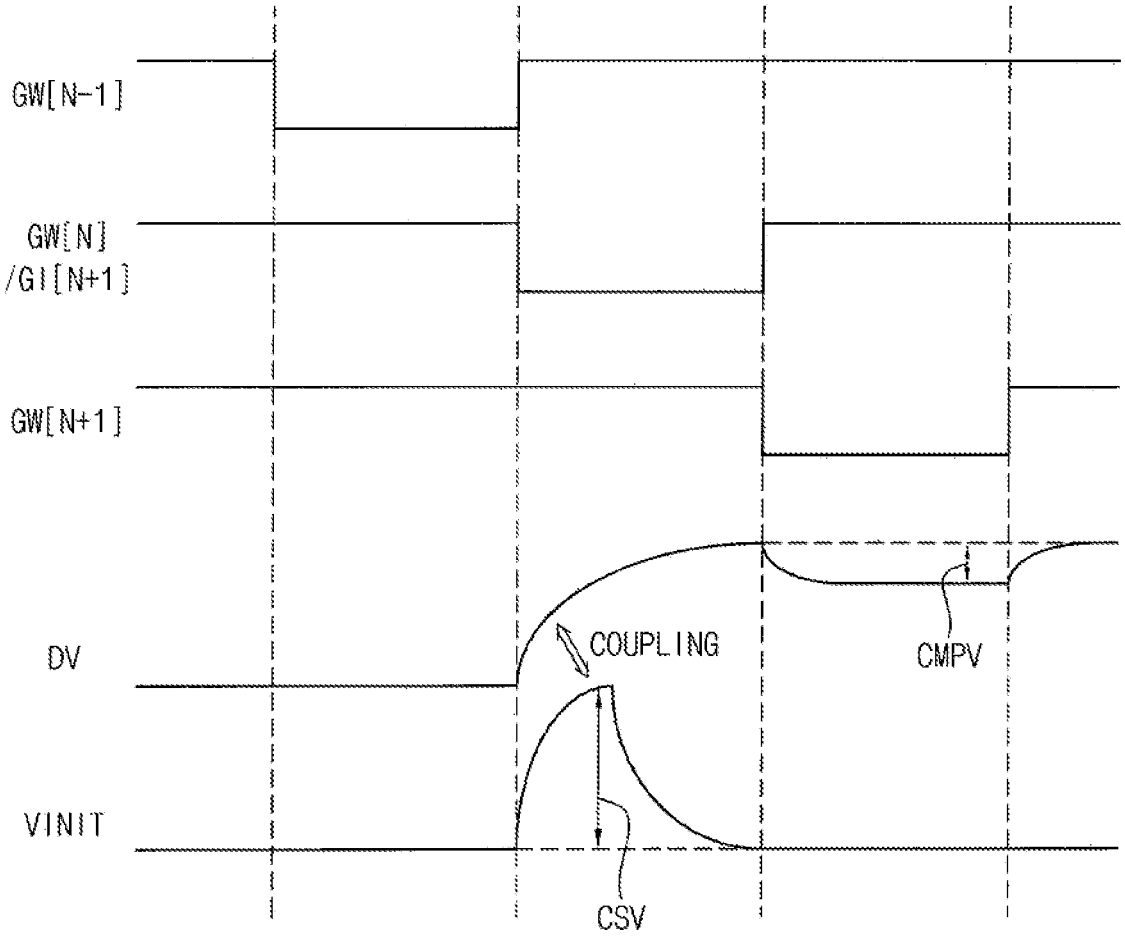
FIG. 5 is a timing diagram for describing an example of an operation of a display device according to exemplary embodiments.

FIG. 1 is a block diagram illustrating a display device according to exemplary embodiments. FIG. 2 is a circuit diagram illustrating an example of each pixel included in a display device according to exemplary embodiments. FIG. 3 is a diagram illustrating an example of image data for a display panel. FIG. 4 is a timing diagram for describing examples where an initial voltage is changed when image data of FIG. 3 are provided in a conventional display device. FIG. 5 is a timing diagram for describing an example of an operation of a display device according to exemplary embodiments. FIG. 6 is a diagram illustrating an example of a compensation map included in a display device according to exemplary embodiments.

Referring to FIG. 1, a display device 100 according to exemplary embodiments may include a display panel 200 including pixels PX, and a display driver 300 for driving the pixels PX. In some exemplary embodiments, the display driver 300 may include a scan driver 310, a data driver 320, a power supply 330, a sensing circuit 340 and a controller 350. In some exemplary embodiments, the display driver 300 may further include an emission driver for providing emission signals to the pixels PX.

The display panel 200 may include gate writing lines, gate initialization lines, data lines DL, a constant voltage line for transferring a constant voltage, and the pixels PX coupled to the gate writing lines, the gate initialization lines, the data lines DL and the constant voltage line. According to some embodiments, the pixels are organized in a matrix according to multiple columns and multiple rows, and each of the data lines DL may provide voltage from the data driver 320 to a row of the pixels PX.

In some exemplary embodiments, the constant voltage may include an initialization voltage VINIT, a high power supply voltage ELVDD, and/or a low power supply voltage ELVSS, and the constant voltage line may include an initialization voltage line VINITL, a line of the high power supply voltage ELVDD, and/or a line of the low power supply voltage ELVSS. For example, as illustrated in FIG. 1, the initialization voltage line VINITL may include horizontal lines respectively formed at rows of the pixels PX, and at least one vertical line for connecting the horizontal lines. However, a structure of the initialization voltage line VINITL is not limited to the example of FIG. 1.

The display panel 200 may further include a feedback line FBL coupled to the constant voltage line. In some exemplary embodiments, as illustrated in FIG. 1, the feedback line FBL may be coupled to the initialization voltage line VINITL for transferring the initialization voltage VINIT to the pixels PX. Further, in some exemplary embodiments, the feedback line FBL may be formed around a display region 210 of the display panel 200 where the pixels PX or emission layers of the pixels PX are located. Additionally or alternatively, the feedback line FBL may be coupled to the initialization voltage line VINITL at an edge portion of the display region 210. For example, as illustrated in FIG. 1, the feedback line FBL may be coupled to the initialization voltage line VINITL at an edge portion of the display region 210 distant from the display driver 300. However, a connection position where the feedback line FBL is connected to the initialization voltage line VINITL is not limited to the example of FIG. 1. In another example, the feedback line FBL may be coupled to the initialization voltage line VINITL at an edge portion of the display region 210 close to the display driver 300.

In some exemplary embodiments, the display panel 200 may be an organic light-emitting diode (OLED) display panel where each pixel PX includes an OLED. For example, as illustrated in FIG. 2, each pixel PX may include a driving transistor T1, a switching transistor T2, a compensating transistor T3, a storage capacitor CST, a first initializing transistor T4, a first emitting transistor T5, a second emitting transistor T6, a second initializing transistor T7, and the organic light-emitting diode EL. The driving transistor T1 may be used or generating a driving current. The switching transistor T2 may be used for transferring a data voltage DV of the data line DL to a source of the driving transistor T1 in response to a gate writing signal GW from the scan driver 310. The compensating transistor T3 may be used for diode-connecting the driving transistor T1 in response to the gate writing signal GW. The storage capacitor CST may be used for storing the data voltage DV transferred through the switching transistor T2 and the diode-connected driving transistor T1. The first initializing transistor T4 may be used for providing the initialization voltage VINIT to a gate node NG connected to the storage capacitor CST and a gate of the driving transistor T1 in response to a gate initialization signal GI from the scan driver 310. The first emitting transistor T5 may be used for connecting the line of the high power supply voltage ELVDD to the source of the driving transistor T1 in response to an emission signal EM from the emission driver. The second emitting transistor T6 may be used for connecting a drain of the driving transistor T1 to an organic light-emitting diode EL in response to the emission signal EM. The second initializing transistor T7 may be used for providing the initialization voltage VINIT to the organic light-emitting diode EL in response to the gate initialization signal GI. The organic light-emitting diode EL may be used for emitting light based on the driving current from the line of the high power supply voltage ELVDD to the line of the low power supply voltage ELVSS. In other exemplary embodiments, the second initializing transistor T7 may operate in response to the gate writing signal GW or another signal.

As illustrated in FIG. 2, a parasitic capacitor CINIT may be formed between the data line DL and the initialization voltage line VINITL. Accordingly, when the data voltage DV of the data line DL changes, the initialization voltage VINIT of the initialization voltage line VINITL may be undesirably changed due to coupling between the data line DL and the initialization voltage line VINITL. Although FIG. 2 illustrates an example of the pixel PX with a 7T1C structure with seven transistors T1 through T7 and one capacitor CST, a structure of each pixel PX of the display device 100 according to exemplary embodiments is not limited to the 7T1C structure. In other exemplary embodiments, the display panel 200 may be a liquid crystal display (LCD) panel, or any other suitable display panel.

The scan driver 310 may generate the gate initialization signals GI and the gate writing signals GW based on a scan control signal SCTRL received from the controller 350, and may sequentially provide the gate initialization signals GI and the gate writing signals GW to the pixels PX on a pixel row basis. In some exemplary embodiments, the scan control signal SCTRL may include, but is not limited to, a scan start signal and a scan clock signal. In some exemplary embodiments, as illustrated in FIG. 1, the scan driver 310 may be integrated or formed in a peripheral portion of the display panel 200 adjacent to the display region 210. In other exemplary embodiments, the scan driver 310 may be implemented with one or more integrated circuits.

The data driver 320 may generate the data voltages DV based on a data control signal DCTRL and compensated image data CIDAT received from the controller 350, and may provide the data voltages DV to the pixels PX through the data lines DL. In some embodiments, the compensated image data may be determined by adjusting a grayscale of the image data. For example, if the change in the constant voltage level will cause a reduced luminance of a pixel, a grayscale of the image data for the pixel may be increased to increase the luminance of the pixel. This increase in the grayscale may compensate for the change in the constant voltage to achieve the desired luminance of the pixel.

In some exemplary embodiments, the data control signal DCTRL may include, but is not limited to, an output data enable signal, a horizontal start signal and a load signal. In some exemplary embodiments, the display driver 300 may be implemented with a signal integrated circuit. The signal integrated circuit may include the data driver 320 and the controller 350. Therefore, the signal integrated circuit may be referred to as a timing controller embedded data driver (TED). As illustrated in FIG. 1, the TED may further include the power supply 330 and the sensing circuit 340, and the scan driver 310 may be formed on the display panel 200. However, the implementations of the display driver 300 and components are not limited to the TED. In other exemplary embodiments, the data driver 320 and the controller 350 may be implemented with separate integrated circuits.

The power supply 330 may convert an input voltage (e.g., a battery voltage or a system voltage) into the initialization voltage VINIT, the high power supply voltage ELVDD and the low power supply voltage ELVSS. Additionally or alternatively, the power supply 330 may provide the initialization voltage VINIT, the high power supply voltage ELVDD and the low power supply voltage ELVSS to the pixels PX. As illustrated in FIG. 1, the initialization voltage VINIT generated by the power supply 330 may be provided to the pixels PX through the initialization voltage line VINITL. Thus, the constant voltage may be provided by the power supply 330 without passing through the data driver 320.

Further, in some exemplary embodiments, the power supply 330 may provide the initialization voltage VINIT with a desired voltage level to the sensing circuit 340 such that the sensing circuit 340 may compare the initialization voltage VINIT at the initialization voltage line VINITL with the initialization voltage VINIT with the desired voltage level. In some exemplary embodiments, as illustrated in FIG. 1, the power supply 330 may be included in the TED. In other exemplary embodiments, the power supply 330 may be implemented with a separate integrated circuit, and the integrated circuit may be implemented with a power management integrated circuit (PMIC).

The sensing circuit 340 may sense, through the feedback line FBL, a change amount of the initialization voltage VINIT induced by the coupling between the data lines DL and the initialization voltage line VINITL when the data voltages DV are changed. Additionally or alternatively, the sensing circuit 340 may generate a change amount sensing value CSV representing the sensed change amount of the initialization voltage VINIT. For example, the sensing circuit 340 may receive the initialization voltage VINIT at the initialization voltage line VINITL through the feedback line FBL, may receive the initialization voltage VINIT with the desired voltage level from the power supply 330, and may sense the change amount of the initialization voltage VINIT by comparing the initialization voltage VINIT at the initialization voltage line VINITL with the initialization voltage VINIT with the desired voltage level. In some exemplary embodiments, as illustrated in FIG. 1, the sensing circuit 340 may be included in the TED. In other exemplary embodiments, the sensing circuit 340 may be implemented with a separate integrated circuit.

The controller 150 (e.g., a timing controller (TCON)) may receive image data IDAT and a control signal CTRL from an external host processor (e.g., a graphic processing unit (GPU) or a graphic card). In some exemplary embodiments, the image data IDAT may be, but is not limited to, RGB image data including red image data, green image data and blue image data. Further, in some exemplary embodiments, the control signal CTRL may include, but is not limited to, a vertical synchronization signal, a horizontal synchronization signal, a master clock signal, an input data enable signal, etc. The controller 350 may control operations of the scan driver 310, the data driver 320, the power supply 330, the sensing circuit 340, and the emission driver based on the image data IDAT and the control signal CTRL.

In a conventional display device that does not include the feedback line FBL and the sensing circuit 340, when the data voltages DV change or transition, the constant voltage (e.g., initialization voltage VINIT) may be changed by coupling between the data lines DL and the constant voltage line (e.g., the initialization voltage line VINITL). Therefore, the pixels PX may not emit with the desired luminance because of the change of the constant voltage, and horizontal crosstalk may occur. In the conventional display device, in a case where the image data IDAT for a display panel 400 are provided as illustrated in FIG. 3, the pixels PX of the display panel 400 may operate as illustrated in FIG. 4.

For example, as illustrated in FIGS. 3 and 4, in the pixels PX located at a first portion 410 of the display panel 400 where the data voltages DV for a current row of pixels PX are substantially the same as the data voltages DV for a previous row of pixels PX, the initialization voltage VINIT may have a constant voltage level 440, or the desired voltage level 440. Accordingly, as indicated by 470 of FIG. 4, a voltage V_NG of the gate node NG at the pixels PX located at the first portion 410 of the display panel 400 may be initialized to the desired voltage level 440 in response to the gate initialization signal GI, and may have a voltage level corresponding to a 128-gray level 128G in response to the gate writing signal GW. Therefore, in the pixels PX located at the first portion 410 of the display panel 400, while the emission signal EM is applied, the driving current IEL flowing through the organic light-emitting diode EL may have a desired current level 510 corresponding to the 128-gray level 128G.

However, with respect to the pixels PX located at a second portion 420 of the display panel 400, in a case where the image data IDAT for a previous row of the pixels PX represent the 128-gray level 128G, and a portion of the image data IDAT for a current row of the pixels PX represent a 0-gray level 0G, the data voltages DV for the current row of pixels PX may be increased from the data voltages DV for the previous row of pixels PX. If the data voltages DV are increased, the initialization voltage VINIT may be changed to a voltage level 450 that may be increased from the desired voltage level 440 due to the coupling between the data line DL and the initialization voltage line VINITL.

If the initialization voltage VINIT has the increased voltage level 450, as indicated by 480 of FIG. 4, the voltage V_NG of the gate node NG at the pixels PX located at the second portion 420 of the display panel 400 may not be sufficiently initialized when the gate initialization signal GI is applied, and may have a voltage level higher than the voltage level corresponding to the 128-gray level 128G when the gate writing signal GW is applied. Therefore, in the pixels PX located at the second portion 420 of the display panel 400, while the emission signal EM is applied, the driving current IEL flowing through the organic light-emitting diode EL may have a current level 520 lower than the desired current level 510 corresponding to the 128-gray level 128G. Accordingly, the pixels PX located at the second portion 420 of the display panel 400 may emit light with luminance lower than the desired luminance, and the horizontal crosstalk may occur in the display panel 400 of the conventional display device. Therefore, embodiments of the present disclosure may sense the change in the constant voltage (i.e., the initialization voltage VINIT) and provide compensated image data to compensate for the horizontal crosstalk.

Further, with respect to the pixels PX located at a third portion 430 of the display panel 400, in a case where a portion of the image data IDAT for a previous row of the pixels PX represent the 0-gray level 0G, and the image data IDAT for a current row of the pixels PX represent the 128-gray level 128G, the data voltages DV for the current row of pixels PX may be decreased from the data voltages DV for the previous row of pixels PX. If the data voltages DV are decreased, the initialization voltage VINIT may be changed to a voltage level 460 that may be decreased from the desired voltage level 440 due to the coupling between the data line DL and the initialization voltage line VINITL.

If the initialization voltage VINIT has the decreased voltage level 460, as indicated by 490 of FIG. 4, the voltage V_NG of the gate node NG at the pixels PX located at the third portion 430 of the display panel 400 may not be excessively initialized when the gate initialization signal GI is applied. Therefore, the voltage V_NG may have a voltage level lower than the voltage level corresponding to the 128-gray level 128G when the gate writing signal GW is applied. Therefore, in the pixels PX located at the third portion 430 of the display panel 400, while the emission signal EM is applied, the driving current IEL flowing through the organic light-emitting diode EL may have a current level 530 higher than the desired current level 510 corresponding to the 128-gray level 128G. Accordingly, the pixels PX located at the third portion 430 of the display panel 400 may emit light with luminance higher than the desired luminance, and the horizontal crosstalk may occur in the display panel 400 of the conventional display device.

However, in the display device 100 according to exemplary embodiments, the display driver 300 may sense the change amount of the initialization voltage VINIT through the feedback line FBL, may generate the compensated image data CIDAT by compensating the image data IDAT according to the sensed change amount of the initialization voltage VINIT, and may provide the data voltages DV corresponding to the compensated image data CIDAT to the pixels PX. Accordingly, the horizontal crosstalk caused by the coupling between the data lines DL and the initialization voltage line VINITL may be reduced or eliminated.

For example, as illustrated in FIG. 5, in a case where the data voltages DV that may be provided to an N-th row of the pixels PX in response to an N-th gate writing signal GW[N] are increased from the data voltages DV that may be provided to an (N−1)-th row of the pixels PX in response to an (N−1)-th gate writing signal GW[N−1], where N is an integer greater than 1, the initialization voltage VINIT of the initialization voltage line VINITL may be increased from the desired voltage level due to the coupling between the data line DL and the initialization voltage line VINITL, and the gate nodes NG of an (N+1)-th row of the pixels PX may be initialized based on the initialization voltage VINIT with the increased voltage level in response to an (N+1)-th gate initialization signal GI[N+1]. However, the sensing circuit 340 of the display driver 300 may sense, through the feedback line FBL, the change amount of the initialization voltage VINIT induced when the data voltages DV for the N-th row of the pixels PX are changed from the data voltages DV for the (N−1)-th row of the pixels PX, and may generate the change amount sensing value CSV representing the sensed change amount of the initialization voltage VINIT.

The controller 350 of the display driver 300 may generate the compensated image data CIDAT to which compensation values CMPV corresponding to the change amount sensing value CSV are applied by compensating the image data IDAT for the (N+1)-th row of the pixels PX based on the change amount sensing value CSV representing the sensed change amount of the initialization voltage VINIT. The data driver 320 of the display driver 300 may provide the data voltages DV to which the compensation values CMPV are applied to the (N+1)-th row of the pixels PX based on the compensated image data CIDAT. Accordingly, the (N+1)-th row of the pixels PX may emit light with the desired luminance based on the data voltages DV to which the compensation values CMPV are applied, and the horizontal crosstalk may be reduced or eliminated in the display device 100 according to exemplary embodiments.

In some exemplary embodiments, to generate the compensated image data CIDAT by compensating the image data IDAT based on the change amount sensing value CSV, the controller 350 may include a data compensator 360 and a compensation map 370. The data compensator 360 may determine the compensation values CMPV corresponding to the change amount sensing value CSV, and may generate the compensated image data CIDAT by adding the compensation values CMPV to the image data IDAT. In some exemplary embodiments, the compensation map 370 may store a plurality of compensation values CMPV according to a plurality of change amount sensing values CSV and a plurality of gray levels, and the data compensator 360 may determine the compensation values CMPV corresponding to the change amount sensing value CSV by using the compensation map 370.

For example, as illustrated in FIG. 6, the compensation map 370 may store the plurality of compensation values CMPV according to the plurality of change amount sensing values CSV and the plurality of gray levels. A gray level (or grayscale) may refer to value that indicates a brightness of a pixel. In one example, the gray level may range from 0 to 255. In some embodiments, the gray level may be combined with values for each color of a pixel to determine the brightness of color sub-pixels within a pixel.

For example the change amount sensing values CSV may be about +0.3V, about +0.2V, about +0.1V, about 0V, about −0.1V, about −0.2V and about −0.3V. Additionally or alternatively, the plurality of gray levels may be a 0-gray level 0G, a 32-gray level 32G, a 64-gray level 64G, a 96-gray level 96G, a 128-gray level 128G, a 160-gray level 160G, a 192-gray level 192G, a 224-gray level 224G and a 255-gray level 255G. The present disclosure is not limited to these change amount sensing values CSV and plurality of gray levels.

For example, in a case where the change amount sensing value CSV represents about +0.3V, with respect to the image data IDAT representing the 0-gray level 0G, the 32-gray level 32G, the 64-gray level 64G, the 96-gray level 96G, the 128-gray level 128G, the 160-gray level 160G, the 192-gray level 192G, the 224-gray level 224G and the 255-gray level 255G, the data compensator 360 may respectively receive the compensation values CMPV representing 0-gray level 0G, +8-gray level+8G, +7-gray level+7G, +7-gray level +7G, +7-gray level+7G, +6-gray level+6G, +6-gray level+ 6G, +5-gray level+5G and 0-gray level 0G from the compensation map 370, and may respectively generate the compensated image data CIDAT representing 0-gray level 0G, 40-gray level, 71-gray level, 103-gray level, 135-gray level, 166-gray level, 198-gray level, 229-gray level and 255-gray level 255G by adding the compensation values CMPV to the image data IDAT.

In another example, in a case where the change amount sensing value CSV represents about −0.3V, with respect to the image data IDAT representing the 0-gray level 0G, the 32-gray level 32G, the 64-gray level 64G, the 96-gray level 96G, the 128-gray level 128G, the 160-gray level 160G, the 192-gray level 192G, the 224-gray level 224G and the 255-gray level 255G, the data compensator 360 may respectively receive the compensation values CMPV representing 0-gray level 0G, −8-gray level −8G, −7-gray level −7G, −7-gray level −7G, −7-gray level −7G, −6-gray level −6G, −5-gray level −5G, −4-gray level −4G and 0-gray level 0G from the compensation map 370, and may respectively generate the compensated image data CIDAT representing 0-gray level 0G, 24-gray level, 57-gray level, 89-gray level, 121-gray level, 154-gray level, 187-gray level, 220-gray level and 255-gray level 255G by adding the compensation values CMPV to the image data IDAT. Although FIG. 6 illustrates an example of the compensation map 370, the compensation map 370, according to exemplary embodiments is not limited to the example of FIG. 6.

As described above, in the display device 100 according to exemplary embodiments, the change amount of the initialization voltage VINIT induced by the coupling between data lines DL and the initialization voltage line VINITL may be sensed through the feedback line FBL, and the image data IDAT may be compensated according to the sensed change amount of the initialization voltage VINIT. Accordingly, the horizontal crosstalk caused by the coupling between the data lines DL and the initialization voltage line VINITL may be reduced or eliminated.

Figure 7:
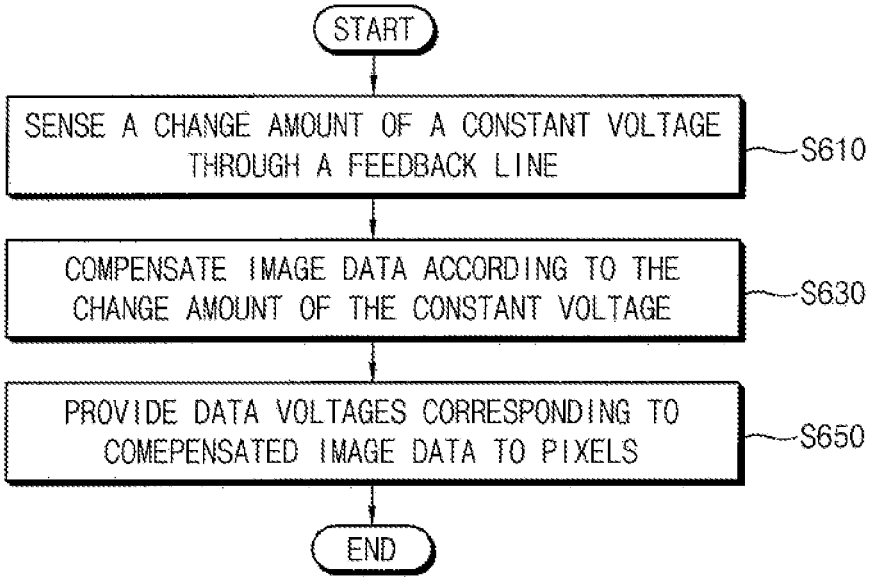
FIG. 7 is a flowchart illustrating a method of operating a display device according to exemplary embodiments.

FIG. 7 is a flowchart illustrating a method of operating a display device according to exemplary embodiments.

Figure 12:
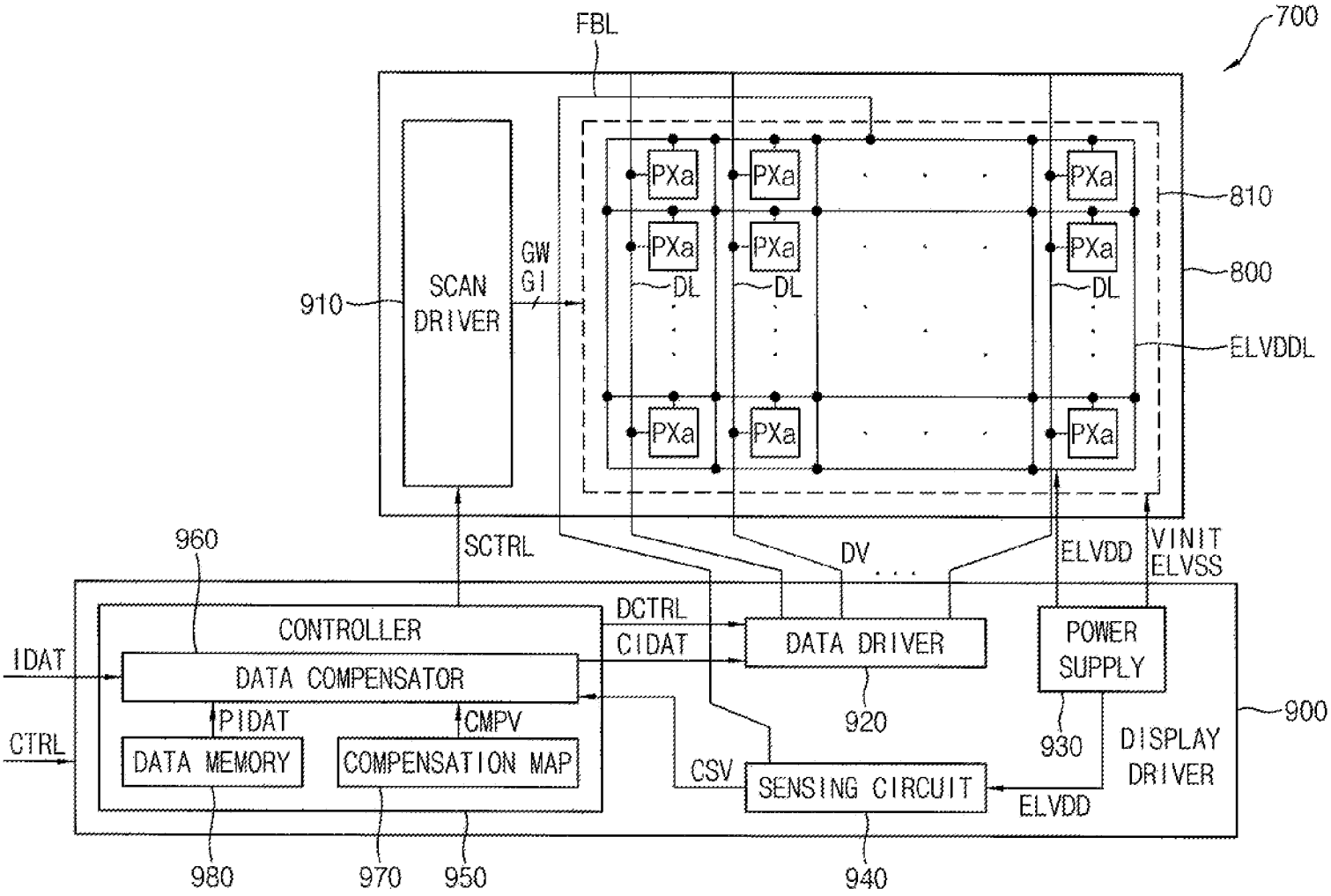
FIG. 12 is a block diagram illustrating a display device according to exemplary embodiments.

Referring to FIGS. 1 and 7, in a method of operating a display device 100 according to exemplary embodiments, a sensing circuit 340 may sense a change amount of a constant voltage of a constant voltage line through a feedback line FBL (S610). In some exemplary embodiments, the sensing circuit 340 may sense, through the feedback line FBL, the change amount of the constant voltage induced by coupling between data lines DL and the constant voltage line when data voltages DV of the data lines DL are changed. In some exemplary embodiments, as illustrated in FIG. 1, the constant voltage may be an initialization voltage VINIT, the constant voltage line may be an initialization voltage line VINITL, and the sensing circuit 340 may sense the change amount of the initialization voltage VINIT through the feedback line FBL. In other exemplary embodiments, as illustrated in FIG. 12, the constant voltage may be a power supply voltage ELVDD (e.g., a high power supply voltage ELVDD), the constant voltage line may be a power supply voltage line ELVDDL, and the sensing circuit 340 may sense the change amount of the power supply voltage ELVDD through the feedback line FBL.

A data compensator 360 may generate compensated image data CIDAT by compensating image data IDAT according to the sensed change amount of the constant voltage (S630). For example, the sensing circuit 340 may sense, through the feedback line FBL, the change amount of the constant voltage induced when the data voltages DV for an N-th row of pixels PX are changed from the data voltages DV for an (N−1)-th row of pixels PX. The data compensator 360 may generate the compensated image data CIDAT data for an (N+1)-th row of pixels PX by compensating the image data IDAT for the (N+1)-th row of the pixels PX according to the sensed change amount of the constant voltage.

A data driver 320 may receive the compensated image data CIDAT from the data compensator 360, and may provide the data voltages DV corresponding to the compensated image data CIDAT to the pixels PX (S950). Accordingly, horizontal crosstalk caused by the coupling between the data lines DL and the constant voltage line may be reduced or eliminated.

Figure 8:
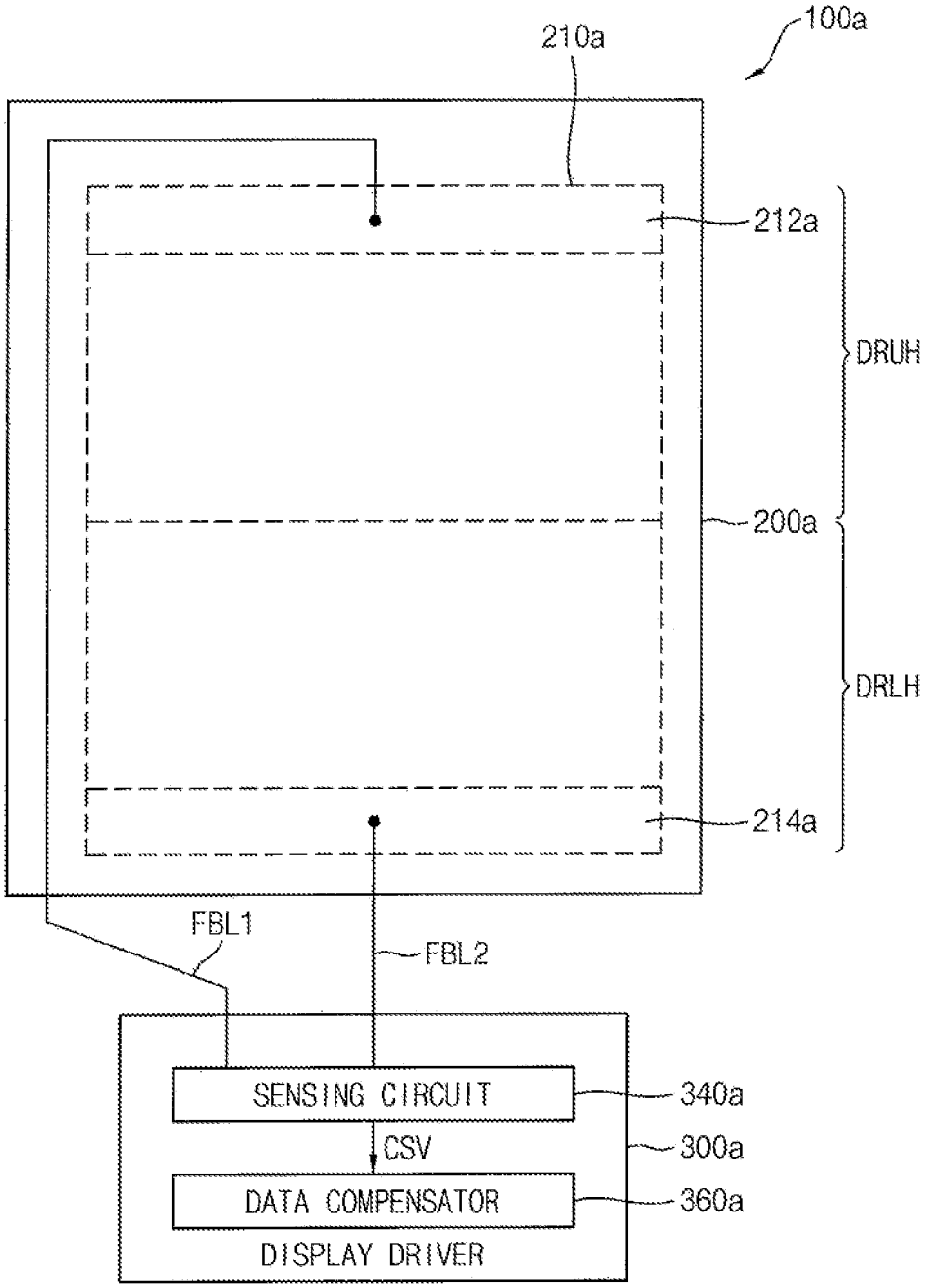
FIG. 8 is a block diagram illustrating a display device according to exemplary embodiments.

FIG. 8 is a block diagram illustrating a display device according to exemplary embodiments.

Referring to FIG. 8, a display device 100*a* according to exemplary embodiments may include a display panel 200*a*, and a display driver 300*a* for driving the display panel 200*a*. The display device 100*a* of FIG. 8 may have a similar configuration and a similar operation to a display device 100 of FIG. 1, except that the display driver 300*a* may compensate image data by using first and second feedback lines FBL1 and FBL2.

The first feedback line FBL1 may be coupled to a constant voltage line (e.g., an initialization voltage line or a power supply voltage line) at a first edge portion 212*a* of a display region 210*a* of the display panel 200*a* distant from the display driver 300*a*. The second feedback line FBL2 may be coupled to the constant voltage line at a second edge portion 214*a* of the display region 210*a* close to the display driver 300*a*.

With respect to a first half (e.g., an upper half DRUH) of the display region 210*a*, a sensing circuit 340*a* of the display driver 300*a* may generate a change amount sensing value CSV by sensing a change amount of a constant voltage (e.g., an initialization voltage or a power supply voltage) through the first feedback line FBL1, and a data compensator 360*a* of the display driver 300*a* may compensate the image data for pixels located at the upper half DRUH of the display region 210*a* based on the change amount of the constant voltage sensed through the first feedback line FBL1. Further, with respect to a second half (e.g., a lower half DRLH) of the display region 210*a*, the sensing circuit 340*a* of the display driver 300*a* may generate a change amount sensing value CSV by sensing the change amount of the constant voltage through the second feedback line FBL2. The data compensator 360*a* of the display driver 300*a* may compensate the image data for pixels located at the lower half DRLH of the display region 210*a* based on the change amount of the constant voltage sensed through the second feedback line FBL2. Accordingly, the change amount of the constant voltage may be more accurately sensed by using the first and second feedback lines FBL1 and FBL2.

Figure 9:
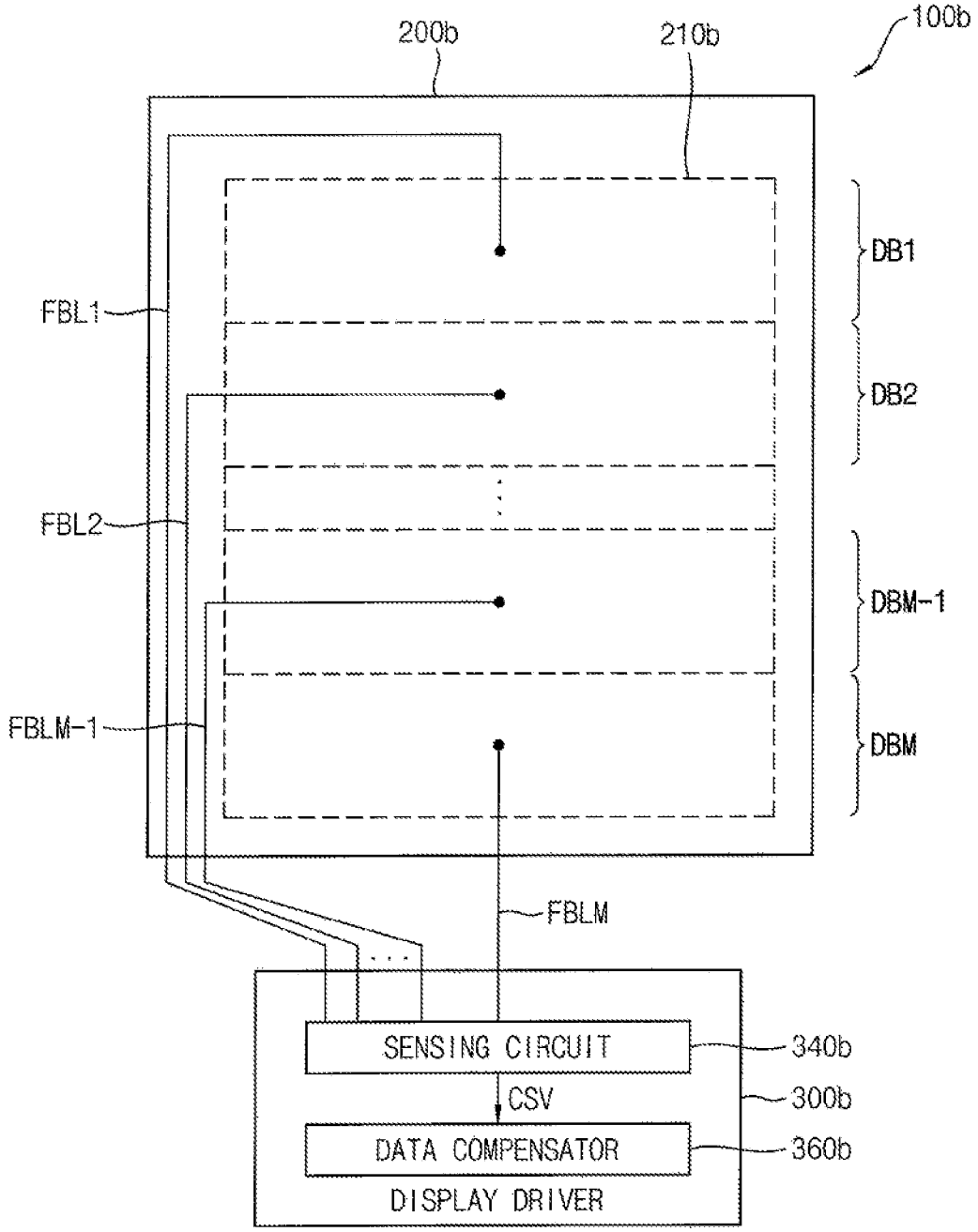
FIG. 9 is a block diagram illustrating a display device according to exemplary embodiments.

FIG. 9 is a block diagram illustrating a display device according to exemplary embodiments.

Referring to FIG. 9, a display device 100*b* according to exemplary embodiments may include a display panel 200*b*, and a display driver 300*b* for driving the display panel 200*b*. The display device 100*b* of FIG. 9 may have a similar configuration and a similar operation to a display device 100 of FIG. 1, except that the display panel 200*b* may include M feedback lines FBL1, FBL2, . . . , FBLM−1 and FBLM, and the display driver 300*b* may compensate image data by using the M feedback lines FBL1, FBL2, . . . , FBLM−1 and FBLM, where M is an integer greater than or equal to 1.

A display region 210*b* of the display panel 200*b* may be divided into M display blocks DB1, DB2, . . . , DBM−1 and DBM. The M feedback lines FBL1, FBL2, . . . , FBLM−1 and FBLM may be coupled to a constant voltage line (e.g., an initialization voltage line or a power supply voltage line) at the M display blocks DB1, DB2, . . . , DBM−1 and DBM, respectively.

The display driver 300*b* may compensate the image data for pixels located at one display block of the M display blocks DB1, DB2, . . . , DBM−1 and DBM based on a change amount of a constant voltage (e.g., an initialization voltage or a power supply voltage) sensed through one of the M feedback lines FBL1, FBL2, . . . , FBLM−1 and FBLM corresponding to the one display block. For example, with respect to a first display block DB1, a sensing circuit 340*b* of the display driver 300*b* may generate a change amount sensing value CSV by sensing the change amount of the constant voltage through a first feedback line FBL1, and a data compensator 360*b* of the display driver 300*b* may compensate the image data for pixels located at the first display block DB1 in response to the change amount sensing value CSV based on the change amount of the constant voltage sensed through the first feedback line FBL1.

Further, with respect to an M-th display block DBM, the sensing circuit 340*b* may generate a change amount sensing value CSV by sensing the change amount of the constant voltage through an M-th feedback line FBLM. The data compensator 360*b* may compensate the image data for pixels located at the M-th display block DBM in response to the change amount sensing value CSV based on the change amount of the constant voltage sensed through the M-th feedback line FBLM. Accordingly, the change amount of the constant voltage may be more accurately sensed by using the M feedback lines FBL1, FBL2, FBLM−1 and FBLM.

Figure 10:
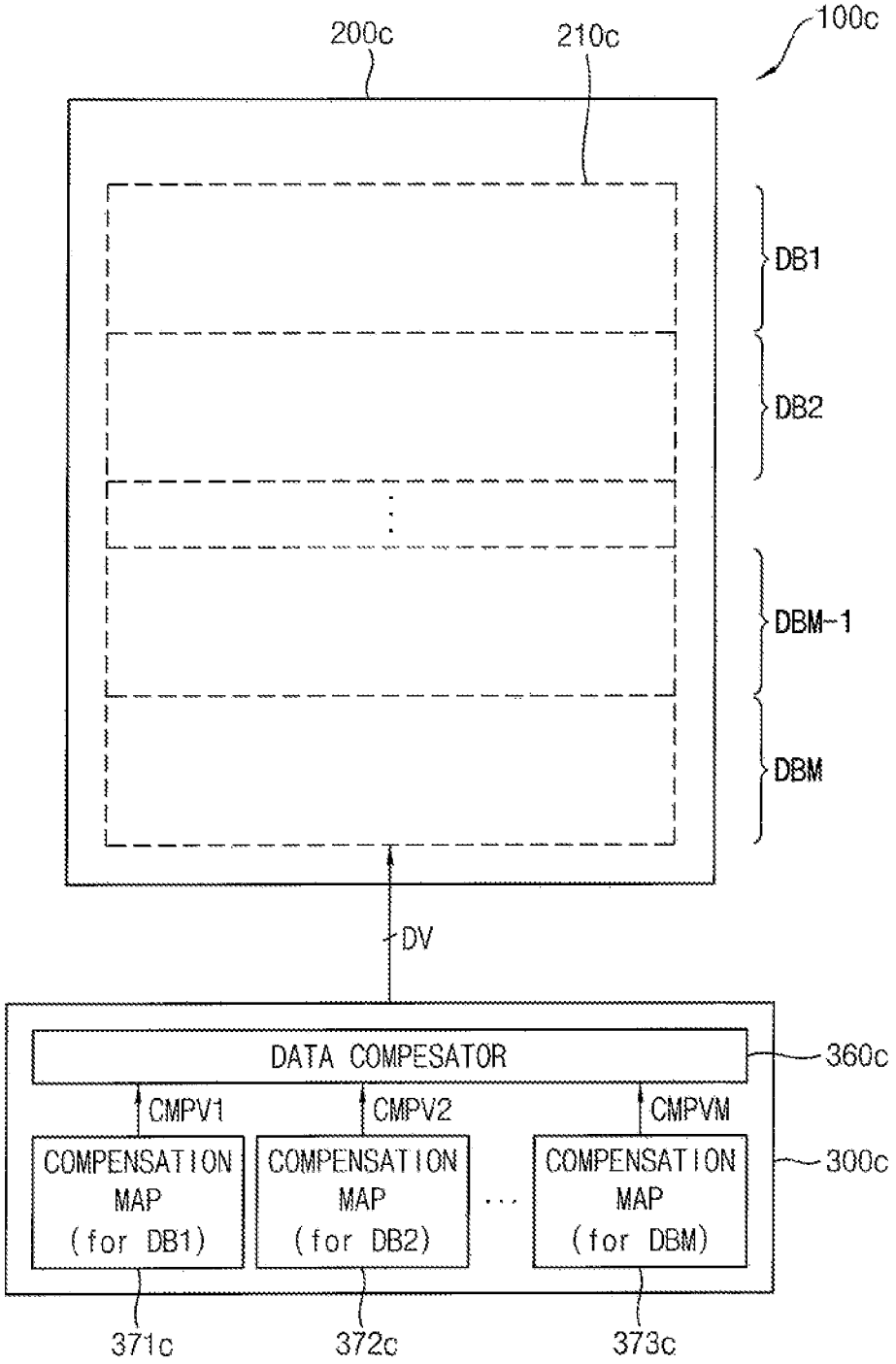
FIG. 10 is a block diagram illustrating a display device according to exemplary embodiments.

FIG. 10 is a block diagram illustrating a display device according to exemplary embodiments.

Referring to FIG. 10, a display device 100*c* according to exemplary embodiments may include a display panel 200*c*, and a display driver 300*c* for driving the display panel 200*c*. The display device 100*c* of FIG. 10 may have a similar configuration and a similar operation to a display device 100 of FIG. 1, except that the display driver 300*c* may include M compensation maps 371*c*, 372*c*, . . . , 373*c*, where M is an integer greater than or equal to 1.

A display region 210*c* of the display panel 200*c* may be divided into M display blocks DB1, DB2, . . . , DBM−1 and DBM. The display driver 300*c* may include the M compensation maps 371*c*, 372*c*, . . . , 373*c* respectively for the M display blocks DB1, DB2, . . . , DBM−1 and DBM. The display driver 300*c* may compensate the image data for pixels located at one display block of the M display blocks DB1, DB2, . . . , DBM−1 and DBM by using one of the M compensation maps 371*c*, 372*c*, . . . , 373*c* corresponding to the one display block. For example, a data compensator 360*c* of the display driver 300*c* may compensate the image data for pixels located at a first display block DB1 by using first compensation values CMPV1 received from a first compensation map 371*c*. Additionally or alternatively, the data compensator 360*c* of the display driver 300*c* may compensate the image data for pixels located at a second display block DB2 by using second compensation values CMPV2 received from a second compensation map 372*c*. The data compensator 360*c* of the display driver 300*c* may also compensate the image data for pixels located at an M-th display block DBM by using M-th compensation values CMPVM received from an M-th compensation map 373*c*. Accordingly, the image data may be more accurately compensated by using the M compensation maps 371*c*, 372*c*, . . . , 373*c*.

Figure 11:
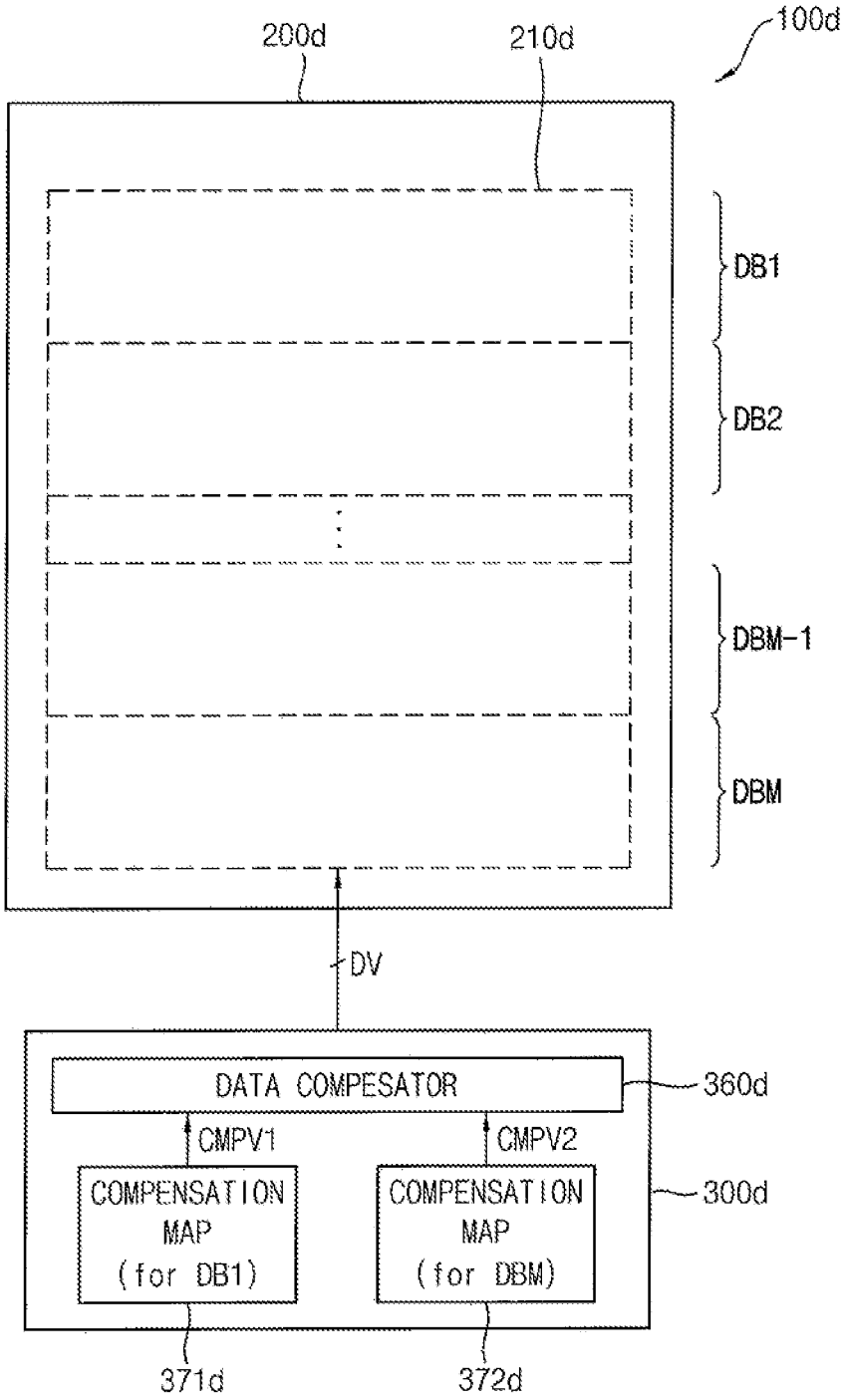
FIG. 11 is a block diagram illustrating a display device according to exemplary embodiments.

FIG. 11 is a block diagram illustrating a display device according to exemplary embodiments.

Referring to FIG. 11, a display device 100*d* according to exemplary embodiments may include a display panel 200*d*, and a display driver 300*d* for driving the display panel 200*d*. The display device 100*d* of FIG. 11 may have a similar configuration and a similar operation to a display device 100 of FIG. 1, except that the display driver 300*d* may include a first compensation map 371*d* for an uppermost display block DB1 and a second compensation map 372*d* for a lowermost display block DBM.

A display region 210*d* of the display panel 200*d* may be divided into M display blocks DB1, DB2, . . . , DBM−1 and DBM. The display driver 300*d* may include the first compensation map 371*d* for the uppermost display block DB1 of the M display blocks DB1, DB2, . . . , DBM−1 and DBM, and the second compensation map 372*d* for the lowermost display block DBM of the M display blocks DB1, DB2, . . . , DBM−1 and DBM. A data compensator 360*d* of the display driver 300*d* may compensate the image data for pixels located at the uppermost display block DB1 by using first compensation values CMPV1 received from the first compensation map 371*d*, and may compensate the image data for pixels located at the lowermost display block DBM by using second compensation values CMPV2 received from the second compensation map 372*d*.

Further, with respect to a display block DB2, . . . , DBM−1 between the uppermost display block DB1 and the lowermost display block DBM among the M display blocks DB1, DB2, . . . , DBM−1 and DBM, the data compensator 360*d* may generate interpolated compensation values by interpolating the first compensation values CMPV1 extracted from the first compensation map 371*d* and the second compensation values CMPV2 extracted from the second compensation map 372*d*, and may compensate the image data for pixels located at the display block DB2, . . . , DBM−1 between the uppermost display block DB1 and the lowermost display block DBM by using the interpolated compensation values. Accordingly, the image data may be more accurately compensated by using the first and second compensation maps 371*d* and 372*d*.

Figure 13:
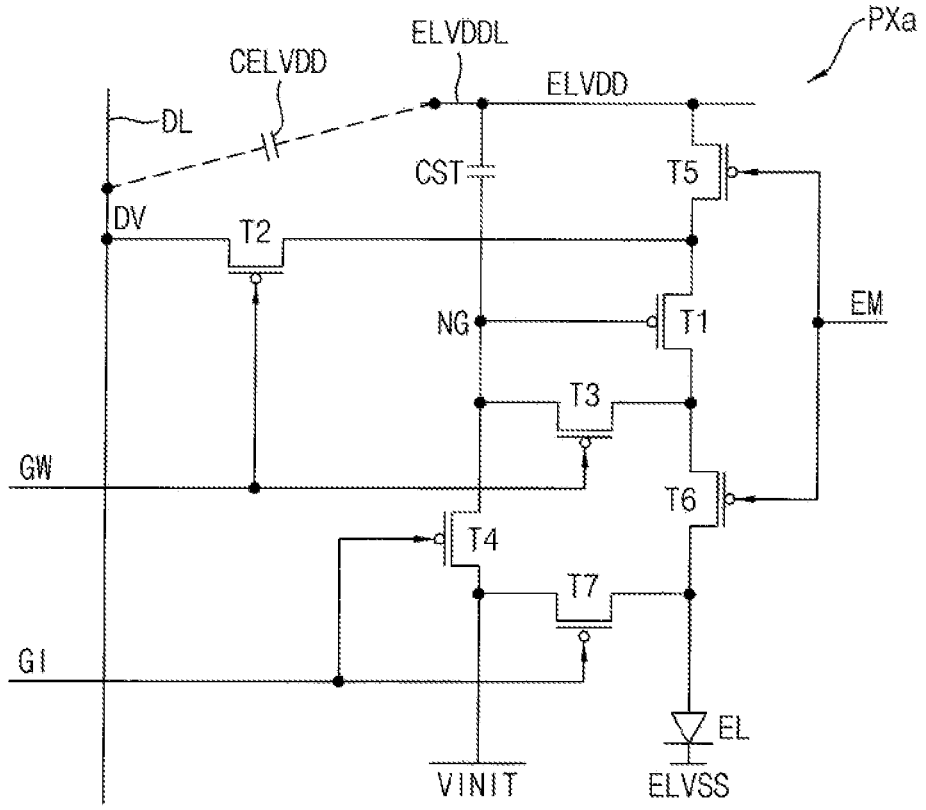
FIG. 13 is a circuit diagram illustrating an example of each pixel included in a display device according to exemplary embodiments.
Figure 14:
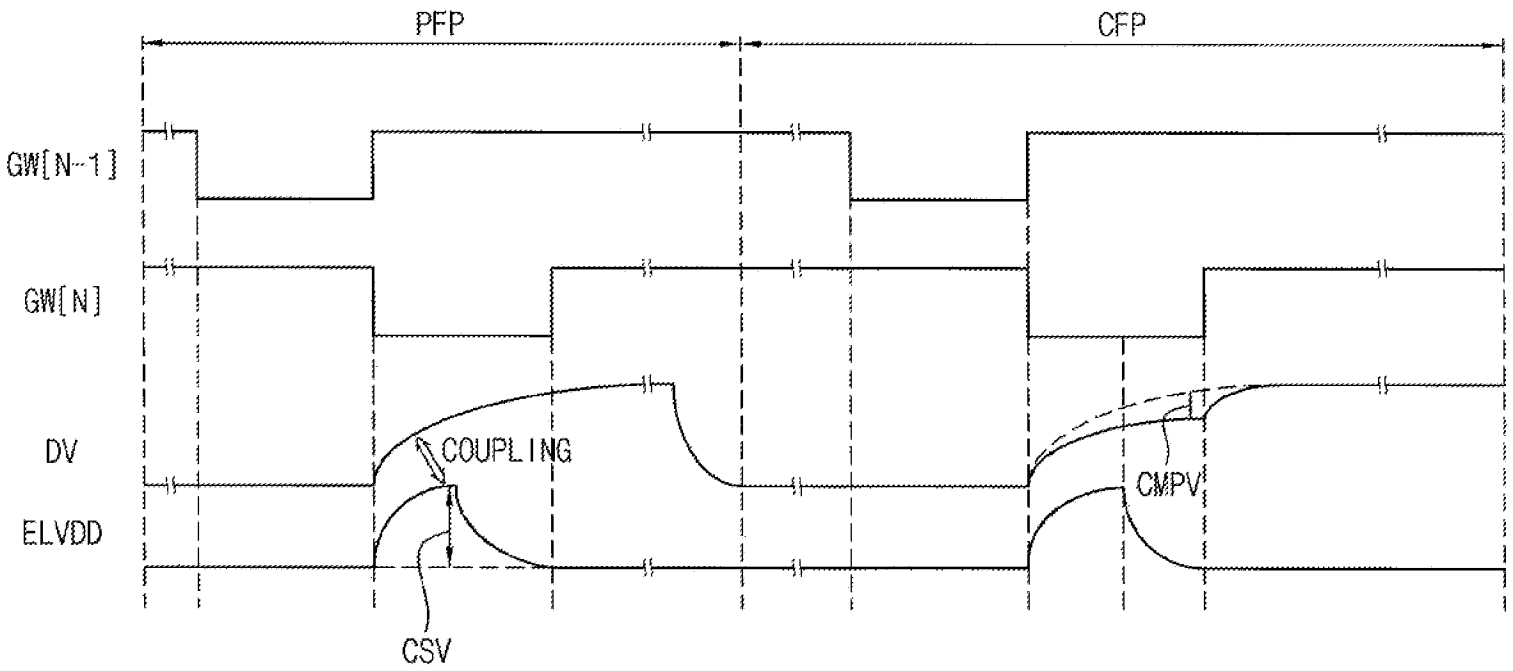
FIG. 14 is a timing diagram for describing an example of an operation of a display device according to exemplary embodiments.

FIG. 12 is a block diagram illustrating a display device according to exemplary embodiments, FIG. 13 is a circuit diagram illustrating an example of each pixel included in a display device according to exemplary embodiments, and FIG. 14 is a timing diagram for describing an example of an operation of a display device according to exemplary embodiments.

Referring to FIG. 12, a display device 700 according to exemplary embodiments may include a display panel 800 including pixels PXa, and a display driver 900 for driving the pixels PXa. In some exemplary embodiments, the display driver 900 may include a scan driver 910, a data driver 920, a power supply 930, a sensing circuit 940 and a controller 950. The controller 950 may include a data compensator 960, a compensation map 970 and a data memory 980. The display device 700 of FIG. 12 may have a similar configuration and a similar operation to a display device 100 of FIG. 1, except that a feedback line FBL may be coupled to a power supply voltage line ELVDDL for transferring a power supply voltage ELVDD, and the controller 950 may further include the data memory 980.

The display panel 800 may include the power supply voltage line ELVDDL, and may further include the feedback line FBL coupled to the power supply voltage line ELVDDL. In some exemplary embodiments, the power supply voltage line ELVDDL may have a mesh structure with a plurality of horizontal lines and a plurality of vertical lines as illustrated in FIG. 12, but the structure of the power supply voltage line ELVDDL is not limited to the example of FIG. 12. Further, as illustrated in FIG. 12, the feedback line FBL may be coupled to the power supply voltage line ELVDDL at an edge portion of a display region 810 distant from the display driver 900. However, a connection position where the feedback line FBL is connected to the power supply voltage line ELVDDL is not limited to the example of FIG. 12. In another example, the feedback line FBL may be coupled to the power supply voltage line ELVDDL at an edge portion of the display region 810 close to the display driver 900. In other exemplary embodiments, the display panel 800 may include two feedback lines FBL as illustrated in FIG. 8, or may M feedback lines FBL as illustrated in FIG. 9.

In each pixel PXa of the display panel 800, as illustrated in FIG. 13, a parasitic capacitor CELVDD may be formed between a data line DL and the power supply voltage line ELVDDL. Accordingly, when a data voltage DV of the data line DL is changed, the power supply voltage ELVDD of the power supply voltage line ELVDDL may be undesirably changed due to coupling between the data line DL and the power supply voltage line ELVDDL.

In the display device 700 according to exemplary embodiments, the display driver 900 may sense a change amount of the power supply voltage ELVDD through the feedback line FBL, may generate compensated image data CIDAT by compensating image data IDAT according to the sensed change amount of the power supply voltage ELVDD, and may provide the data voltages DV corresponding to the compensated image data CIDAT to the pixels PXa. Accordingly, horizontal crosstalk caused by the coupling between the data lines DL and the power supply voltage line ELVDDL may be reduced or eliminated.

In some exemplary embodiments, as illustrated in FIG. 14, the sensing circuit 940 of the display driver 900 may generate a change amount sensing value CSV by sensing the change amount of the power supply voltage ELVDD through the feedback line FBL in a previous frame period PFP. The image data IDAT in the previous frame period PFP may be stored in the data memory 980. In a case where the image data IDAT in a current frame period CFP are substantially the same as the image data IDAT in the previous frame period PFP stored in the data memory 980, the data compensator 960 of the display driver 900 may generate the compensated image data CIDAT to which compensation values CMPV are applied.

Generating compensated image data CIDAT may be performed by compensating the image data IDAT in the current frame period CFP according to the sensed change amount of the power supply voltage ELVDD in the previous frame period PFP. In some embodiments, gray values of the image data may be adjusted to compensate for the sensed change amount. For example, increasing a gray value may increase the luminance of a pixel to compensate for a decrease in a luminance caused by the sensed change amount of the power supply voltage.

Accordingly, in the current frame period CFP, the data voltages DV to which the compensation values CMPV are applied may be provided to the pixels PXa, the pixels PXa may emit light with desired luminance, and the horizontal crosstalk caused by the coupling between the data line DL and the power supply voltage line ELVDDL may be reduced or eliminated in the display device 700 according to exemplary embodiments.

Figure 15:
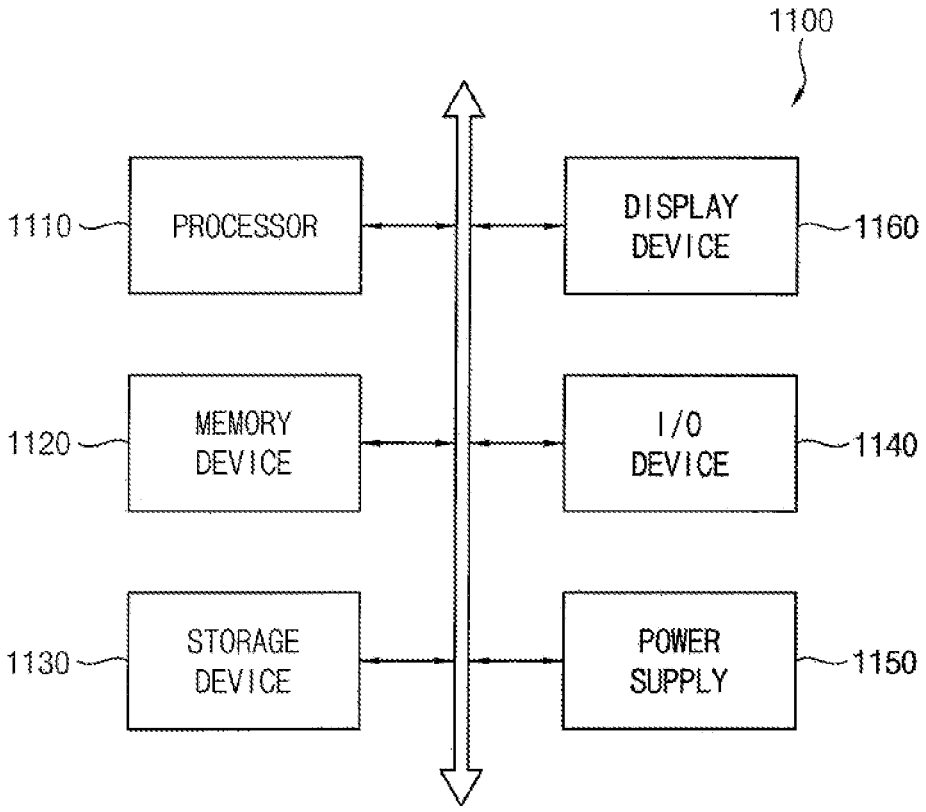
FIG. 15 is a block diagram illustrating an electronic device including a display device according to exemplary embodiments.

FIG. 15 is a block diagram illustrating an electronic device including a display device according to exemplary embodiments.

Referring to FIG. 15, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some exemplary embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

In the display device 1160, a change amount of a constant voltage (e.g., an initialization voltage, a power supply voltage, etc.) induced by coupling between data lines and a constant voltage line may be sensed through a feedback line, and image data may be compensated according to the sensed change amount of the constant voltage. Accordingly, horizontal crosstalk caused by the coupling between the data lines and the constant voltage line may be reduced or eliminated.

The inventive concepts may be applied to any display device 1160, and any electronic device 1100 including the display device 1160. For example, the inventive concepts may be applied to a mobile phone, a smartphone, a tablet computer, a wearable electronic device, a virtual reality (VR) device, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel including pixels, data lines for transferring data voltages to the pixels, a constant voltage line for transferring a constant voltage to the pixels, and a feedback line coupled to the constant voltage line; and a display driver configured to sense a change amount of the constant voltage through the feedback line, to generate compensated image data by compensating image data according to the sensed change amount of the constant voltage, and to provide the data voltages corresponding to the compensated image data to the pixels, wherein the constant voltage is an initialization voltage, and the constant voltage line is an initialization voltage line.

2. The display device of claim 1, wherein the display driver is configured to sense, through the feedback line, the change amount of the constant voltage induced by coupling between the data lines and the constant voltage line when the data voltages are changed.

3. The display device of claim 1, wherein the display driver is configured to sense, through the feedback line, the change amount of the constant voltage induced when the data voltages for an N-th row of the pixels are changed from the data voltages for an (N−1)-th row of the pixels, where N is an integer greater than 1, generate the compensated image data for an (N+1)-th row of the pixels by compensating the image data for the (N+1)-th row of the pixels according to the sensed change amount of the constant voltage, and provide the data voltages corresponding to the compensated image data to the (N+1)-th row of the pixels.

4. The display device of claim 1, wherein the display driver includes:

a sensing circuit configured to generate a change amount sensing value by sensing the change amount of the constant voltage through the feedback line;

a data compensator configured to determine compensation values corresponding to the change amount sensing value, and to generate the compensated image data by adding the compensation values to the image data; and a data driver configured to receive the compensated image data from the data compensator, and to provide the data voltages corresponding to the compensated image data to the pixels.

5. The display device of claim 1, wherein the display panel includes, as the feedback line, a first feedback line coupled to the constant voltage line at a first edge portion of a display region of the display panel distant from the display driver, and a second feedback line coupled to the constant voltage line at a second edge portion of the display region close to the display driver.

6. The display device of claim 5, wherein the display driver is configured to compensate the image data for the pixels located at a first half of the display region based on the change amount of the constant voltage sensed through the first feedback line, and to compensate the image data for the pixels located at a second half of the display region based on the change amount of the constant voltage sensed through the second feedback line.

7. The display device of claim 1, wherein a display region of the display panel is divided into a plurality of display blocks, and wherein the display panel includes, as the feedback line, a plurality of feedback lines coupled to the constant voltage line at the plurality of display blocks, respectively.

8. The display device of claim 7, wherein the display driver compensates the image data for the pixels located at one display block of the plurality of display blocks based on the change amount of the constant voltage sensed through one of the plurality of feedback lines corresponding to the one display block.

9. The display device of claim 1, wherein the display driver includes:

a compensation map configured to store a plurality of compensation values according to a plurality of change amount sensing values and a plurality of gray levels, and wherein the display driver compensates the image data by using the compensation map.

10. The display device of claim 1, wherein a display region of the display panel is divided into a plurality of display blocks, wherein the display driver includes:

a plurality of compensation maps corresponding to the plurality of display blocks, and wherein the display driver is configured to compensate the image data for the pixels located at one display block of the plurality of display blocks by using one of the plurality of compensation maps corresponding to the one display block.

11. The display device of claim 1, wherein a display region of the display panel is divided into a plurality of display blocks, wherein the display driver includes:

a first compensation map for an uppermost display block of the plurality of display blocks; and a second compensation map for a lowermost display block of the plurality of display blocks, and wherein the display driver is configured to compensate the image data for the pixels located at one display block of the plurality of display blocks by interpolating first compensation values extracted from the first compensation map and second compensation values extracted from the second compensation map.

12. The display device of claim 1, wherein the display driver is configured to sense the change amount of the constant voltage through the feedback line in a previous frame period, and to compensate the image data in a current frame period according to the sensed change amount of the constant voltage in the previous frame period when the image data in the current frame period are substantially the same as the image data in the previous frame period.

13. A display device comprising:

a display panel including pixels, data lines for transferring data voltages to the pixels, a constant voltage line for transferring a constant voltage to the pixels, and a feedback line coupled to the constant voltage line; and a display driver configured to sense a change amount of the constant voltage through the feedback line, to generate compensated image data by compensating image data according to the sensed change amount of the constant voltage, and to provide the data voltages corresponding to the compensated image data to the pixels, wherein the feedback line is formed around a display region of the display panel where the pixels are located, and is coupled to the constant voltage line at an edge portion of the display region.

14. A method of operating a display device, the method comprising:

sensing a change amount of a constant voltage of a constant voltage line through a feedback line, wherein the constant voltage is an initialization voltage, and the constant voltage line is an initialization voltage line;

generating compensated image data by compensating image data according to the sensed change amount of the constant voltage; and providing data voltages to pixels based on the compensated image data.

15. The method of claim 14, wherein sensing the change amount of the constant voltage includes:

sensing, through the feedback line, the change amount of the constant voltage induced by coupling between data lines and the constant voltage line when data voltages of the data lines are changed.

16. The method of claim 14, wherein sensing the change amount of the constant voltage includes:

sensing, through the feedback line, the change amount of the constant voltage induced when the data voltages for an N-th row of the pixels are changed from the data voltages for an (N−1)-th row of the pixels, where N is an integer greater than 1, and wherein generating the compensated image data includes:

generating the compensated image data for an (N+1)-th row of the pixels by compensating the image data for the (N+1)-th row of the pixels according to the sensed change amount of the constant voltage.

* * * * *